United States Patent [19]

Johnson

[11] Patent Number: 4,549,316

[45] Date of Patent: Oct. 29, 1985

[54] FOLDABLE HAT

[75] Inventor: Kenneth L. Johnson, Kansas City, Kans.

[73] Assignee: Capmakers, Ltd., Kansas City, Mo.

[21] Appl. No.: 547,327

[22] Filed: Oct. 31, 1983

[51] Int. Cl.[4] ..... A42B 1/20

[52] U.S. Cl. ..... 2/195

[58] Field of Search ..... 2/175, 195, 196, 198, 2/197, 199, 200, 201; D2/244, 230, 257, 235

[56] References Cited

U.S. PATENT DOCUMENTS

| | | | |
|---|---|---|---|
| 1,103,876 | 7/1914 | Herrmann | D2/257 X |
| 1,190,427 | 7/1916 | Kromer, Jr. | 2/195 |
| 1,446,411 | 2/1923 | Berman . | |
| 1,569,658 | 1/1926 | Levinson | 2/195 |
| 1,752,172 | 3/1930 | Gust | D2/230 X |
| 2,136,925 | 11/1938 | Ristell et al. | D2/230 X |
| 2,218,947 | 10/1940 | Brunzell | 2/195 X |
| 2,264,594 | 12/1941 | Schuessler | 2/195 |
| 2,390,064 | 12/1945 | Gardner | 2/195 X |
| 2,623,213 | 12/1952 | Provitola et al. | D2/230 X |
| 3,357,026 | 12/1967 | Wiegandt | 2/195 |
| 3,362,028 | 1/1968 | Leopardo | D2/235 X |

FOREIGN PATENT DOCUMENTS

| | | | |
|---|---|---|---|
| 871272 | 1/1942 | France | 2/175 |

*Primary Examiner*—Werner H. Schroeder
*Assistant Examiner*—T. Graveline
*Attorney, Agent, or Firm*—Rogers, Howell, Renner, Moore & Haferkamp

[57] ABSTRACT

An improved hat with a visor having at least one preformed fold line along which the visor can be folded into a compact configuration for storing in a pocket or the like, without permanently distorting the visor.

13 Claims, 6 Drawing Figures

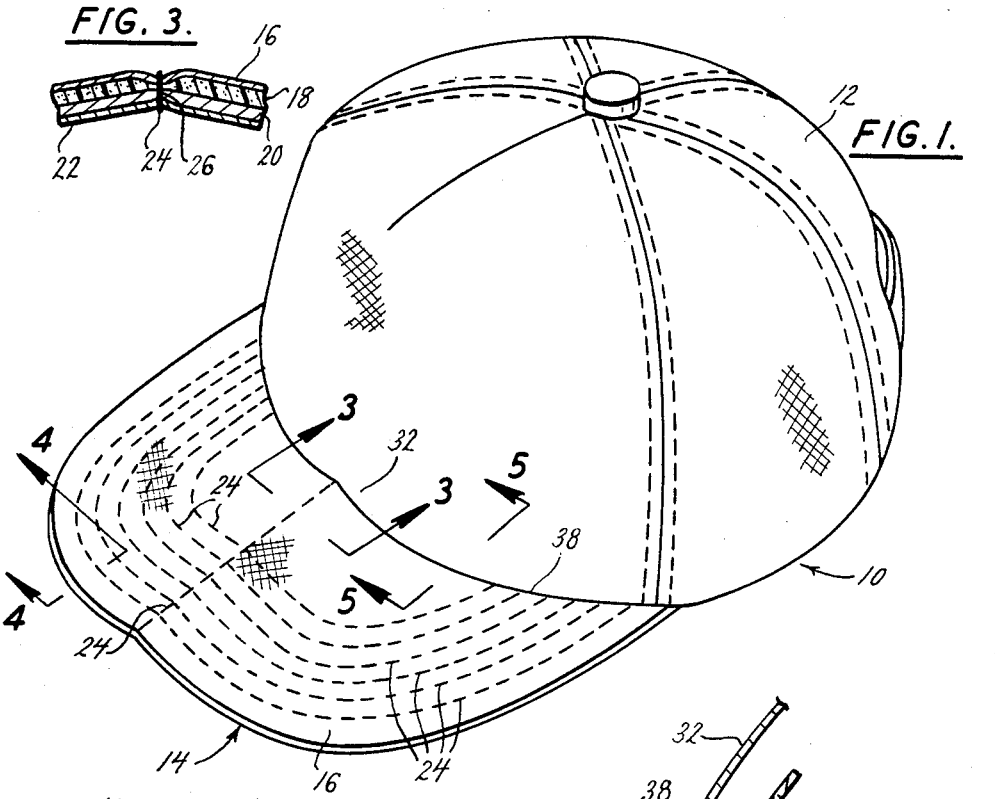
FIG. 3.
16
18
22
24
26
20
12
FIG. 1.
4
3
32
5
24
38
10
14
16
24
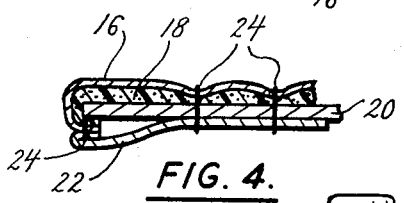
16
18
24
20
24
22
FIG. 4.
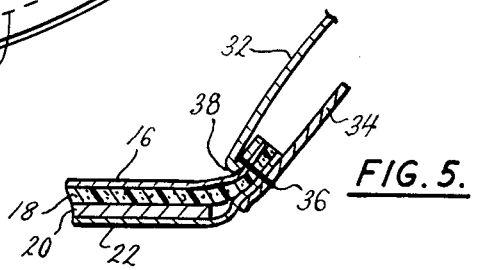
32
38
34
16
36
18
20
22
FIG. 5.
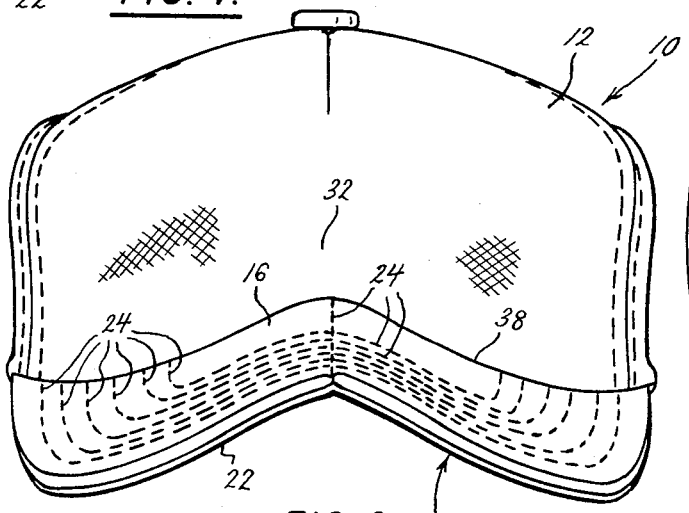
12
10
32
16
24
38
24
22
14
FIG. 2.
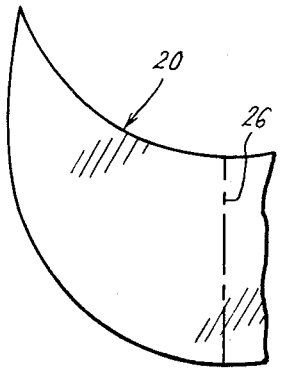
20
26
FIG. 6.

FOLDABLE HAT

BACKGROUND AND SUMMARY OF THE INVENTION

This invention relates to an improved hat, and more specifically to a hat having a beak or visor which may be readily folded so that the hat can be placed in a hip pocket or the like when not in use. The term "hat" is meant to include any type of headpiece having a visor portion for shading the eyes from the sun or glare, and may include hats with head coverings or only head bands to which the visor portion is attached. It also includes what is commonly called a "cap" where the visor portion extends only to the front.

Hats are not suitable for storing in a pocket because of the stiffness of the visor portion of the hat. Commonly the wearer will stuff the flexible portion that covers or surrounds the head in his pocket, leaving the visor hanging out so as not to be crushed. This technique is somewhat awkward, and not very secure. Prior art attempts at solving the problem are exemplifid by U.S. Pat. Nos. 1,446,411 and 1,190,427 by providing a construction which allegedly allows folding of the visor without loss of shape. Applicant has solved the problem by providing a visor construction with a pre-formed fold line such that the visor can be folded along the fold line for placement in a hip pocket or the like, and then unfolded for use without mutilation. In this way the visor retains its original shape and remains pleasing to the eye.

Applicant's hat functions just as any other when being worn. When removed from the head it can be folded to provide for convenient storage. The visor may be folded first along the fold line to a generally flat configuration and then the body portion, the portion covering or surrounding the head, folded about the now folded visor to a compact and convenient size for placement in a pocket, golf bag, glove compartment, etc. Alternatively, the body portion can be folded first, with the visor then folded about the body or next to the already folded body. Regardless of the sequence of folding, once folded it is of a compact and convenient size for storage.

A more complete understanding of applicant's invention may be attained through a review of the drawings and the following description of the preferred embodiment.

BRIEF DESCRIPTION OF THE DRAWINGS

FIG. 1 is a perspective view of a hat of this invention;

FIG. 2 is a front view of the hat of FIG. 1 with the visor slightly folded along the fold line;

FIG. 3 is a section along 3—3 of FIG. 1 showing the fold line;

FIG. 4 is a section of the visor along 4—4 of FIG. 1;

FIG. 5 is a section along 5—5 of FIG. 1; and

FIG. 6 is a top view of the stiffening layer used in the hat of this invention.

DETAILED DESCRIPTION OF THE PREFERRED EMBODIMENT

With reference to the drawing, a hat 10 has a body portion 12 and a visor portion 14. The body portion may be made of cloth or the like of any suitable material. The visor 14, located on a front edge of the body, is composed of layers of fabric and stiffening material which can be best seen in FIGS. 3 and 4. The visor is composed of an upper fabric layer 16 wth a backing 18 made of foam or other spongy material, a stiffening layer 20 of cardboard or other suitable material, and lower fabric layer 22.

As shown in FIG. 4, upper fabric 16 and backing 18 are turned under along the front edge of the stiffening layer 20, and the lower fabric layer 22 is folded over and sewn to the upper fabric and backing with stitches 24. All the layers of the visor, the upper fabric 16 and backing 18, stiffening layer 20, and lower fabric layer 22, are stitched together by curvilinear rows of stitching 24.

In accordance with this invention, the visor 14 is provided with a pre-formed fold line 26 extending from the forward to the rearward edges of the visor at a central location. This fold line is formed by either precreasing the stiffening layer, perforating the stiffening layer, or constructing the stiffening layer in two separate halfs which are disconnected at the fold line. In each of these modified constructions, stitching 24 extends along the fold line through all of the layers of the visor to provide further definition to the fold line and add strength to the visor at that location.

The attachment of the visor portion to the body portion is generally conventional such that the upper fabric and backing layer and the lower fabric layer are sewn to the body portion as shown in FIG. 5. Hence, the visor layers may be sewn between an upper fabric layer 32 and a hat band 34 of the body portion by stitching 36. In the preferred embodiment of the invention, the stiffening layer is of a shape shown in FIG. 6, and is substantially coextensive with the visor such that its edges substantially coincide with those of the visor, but such that the rearward edge of the stiffening layer is not sewn to the body portion (see FIG. 5). This allows a substantial degree of flexibility between the visor and the body along the line 38 to facilitate folding of the hat to a collapsed compact configuration. At the same time, with the rearward edge of this stiffening layer substantially coexistive with that of the line 38, the placing of the hat on the head urges the visor to a more flattened configuration as compared to when the hat is not worn. In other words, the wearer's head acts to hold the visor in the unfolded configuration.

There are various changes and modifications which may be made to applicant's invention as would be apparent to those skilled in the art. However, any of these changes or modifications are included in the teaching of applicant's disclosure and he intends that his invention be limited only by the scope of the claims as appended hereto.

What I claim is:

1. A foldable hat comprising a body portion for placement of the hat on the head, and a visor portion, said visor portion including an upper fabric layer, a lower fabric layer, and a stiffening layer therebetween, all of substantially the same shape, said layes being attached together by generally curvilinear rows of stitching extending therethrough, means defining a pre-formed fold line between the front and rearward edges of the visor at an intermediate location, said means including stitching along said fold line extending through said fabric layers, said visor being foldable along said stitching of said fold line, said stiffening layer being detached from said body portion except through said upper and lower layers, and said stiffening layer having a rearward edge substantially coextensive with the line of connection between the visor and body portions such that placement of the hat on the head urges the visor portion to unfold along the fold line.

2. A foldable hat comprising a body portion for placement of the hat on the head of the wearer and a visor portion, said visor portion having an upper fabric layer, a lower fabric layer, and a stiffening layer therebetween, said stiffening layer being substantially coextensive with said visor portion and having a rearward edge substantially coextensive with the line of connection between the body and visor portions, said visor further having a front edge, said visor portion further having at least one pre-formed fold line at an intermediate location extending from the rear edge to the front edge of the visor portion, said fold line having stitching therealong, said visor portion being foldable along said fold line, whereby placement of the hat on the head urges the visor portion to unfold along the fold line.

3. A foldable hat comprising a relatively flexible body portion for conforming generally to the head of the wearer when worn, and a visor having a rear edge and a front edge, the visor comprised of multiple layers attached to the body portion along the visor's rear edge, said visor including a stiffening layer substantially coextensive with the visor, the stiffening layer having at least one pre-formed fold line along which the visor can be folded and unfolded, the fold line being generally straight and extending from the rear edge to the front edge.

4. The foldable hat of claim 3 wherein the pre-formed fold line extends at a central location of the visor.

5. The foldable hat of claim 3 wherein the visor comprises an upper layer and a lower layer with the stiffening layer therebetween, the stiffening layer comprising at least two separate sections defining a pre-formed fold line along the line of separation.

6. The foldable hat of claim 3 further comprising stitching through said flexible layers along the pre-formed fold line.

7. The foldable hat of claim 3 wherein the stiffening layer comprises two substantially equal halves defining one pre-formed fold line extending from the front of the stiffening layer to the rear at a central location.

8. The foldable hat of claim 7 wherein said stiffening layer is pre-creased to define said pre-formed fold line.

9. The foldable hat of claim 7 wherein said stiffening layer is perforated to define said pre-formed fold line.

10. The foldable hat of claim 7 wherein said stiffening layer comprises multiple disconnected sections defining said pre-formed fold line.

11. The foldable hat of claim 7 wherein the stiffening layer is unattached to the body portion except by means of the upper and lower layers of the visor portion.

12. The foldable hat of claim 11 whereby said visor further comprises layers of flexible material covering the top and bottom of said stiffening layer and extending over said fold line.

13. The foldable hat of claim 12 wherein the rear edge of the stiffening layer is substantially coextensive with the line of connection between the body portion and visor such that engagement of the body portion on the wearer's head causes the visor to unfold.

* * * * *